United States Patent [19]

Fulcher

[11] Patent Number: 5,022,647

[45] Date of Patent: Jun. 11, 1991

[54] UPPER TORSO AND LIMB EXERCISING DEVICE

[76] Inventor: Garland J. Fulcher, 14007 Highmark Sq., Dallas, Tex. 75240

[21] Appl. No.: 561,276

[22] Filed: Aug. 1, 1990

Related U.S. Application Data

[63] Continuation of Ser. No. 354,474, May 19, 1989, abandoned.

[51] Int. Cl.[5] ..... A63B 21/06

[52] U.S. Cl. ..... 272/117; 272/67; 272/134; 273/191 B

[58] Field of Search ..... 272/67, 117, 118, 123, 272/134, 143, 900; 273/191 B, 193 A

[56] References Cited

U.S. PATENT DOCUMENTS

| | | | |
|---|---|---|---|
| 3,019,019 | 1/1962 | Forte | 272/117 |
| 3,115,339 | 12/1963 | Forte | 272/117 |
| 4,072,308 | 2/1978 | Applegate . | |
| 4,229,002 | 10/1980 | Masters | 272/117 |
| 4,239,208 | 12/1980 | Walls . | |
| 4,243,219 | 1/1981 | Price | 272/117 |
| 4,257,590 | 3/1981 | Sullivan et al. | 272/117 |
| 4,258,913 | 3/1981 | Brentham | 272/143 X |
| 4,353,546 | 10/1982 | Rhoades | 272/117 |
| 4,373,717 | 2/1983 | Lambert, Jr. . | |
| 4,392,649 | 7/1983 | Chapman . | |
| 4,482,149 | 11/1984 | Weldon . | |
| 4,489,935 | 12/1984 | Lusk . | |
| 4,553,747 | 11/1985 | Pursley | 272/118 |
| 4,570,925 | 2/1986 | Kock et al. . | |
| 4,598,908 | 7/1986 | Morgan | 272/117 |
| 4,623,148 | 11/1986 | Juhl | 272/117 X |
| 4,645,203 | 2/1987 | Moss . | |
| 4,721,303 | 1/1988 | Fitzpatrick | 272/117 |

*Primary Examiner*—Robert Bahr

*Attorney, Agent, or Firm*—Johnson & Gibbs

[57] ABSTRACT

An upper torso and limb conditioner and exerciser useful for conditioning and strengthening the upper torso and limb thereby forming a natural resistance to the speed of a swinging golf club head. The apparatus is to be used with at least one weight in the exercising of a user's upper torso and limb. The apparatus includes a support frame with at least one upright member attached to at least one transverse top member, and at least one rest secured substantially parallel to the upright member adapted for engaging, receiving and supporting a selected region of the user's body to facilitate the lateral or longitudinal movement of the upper torso and limb while raising and lowering the weight. A pulley sheave is movably mounted on the top frame member, and a flexible cord passes over the pulley sheave and is coupled to the weight at the lower end thereof. The upper end of the cord is adapted to be grasped by the user's fingers along the palm of hand for raising and lowering the weight in the exercising of the upper torso and limb.

19 Claims, 4 Drawing Sheets

UPPER TORSO AND LIMB EXERCISING DEVICE

This is a continuation of application Ser. No. 07/354,474, filed May 19, 1989 now abandoned.

BACKGROUND OF THE INVENTION

The present invention relates generally to an exercising device and, more particularly, to exercising devices for the development of pertinent muscles related to the use of the upper torso and limb, such as shoulder, forearm, wrist, hand, and fingers, for activities such as golf, tennis, baseball, and other non-sport activities.

Golfers as well as tennis players, and to some extent baseball players, need strength in their shoulders, hands, wrists, forearms, and fingers in a very special way. Among the posterior muscles of the forearm needed for a good golf swing are: flexor carpi ulnaris, extensor carpi ulnaris, and extensor digiti minimi. Among the muscles around the wrist that are necessary for a good golf swing are abductor pollicis longus, extensor pollicis brevis, extensor indicis, and abductor pollicis longus. Moreover, shoulder, thumb, forefinger, and middle finger are also involved in the swing of a golf club. A good golfer must have a strong shoulder, forearm, wrist, and hand in a natural resistance to the club head speed of a swinging golf club.

Occasionally, people confined to beds or wheelchairs also need to exercise certain muscles related to upper torso and limbs. This exercise will prevent the deterioration of those related muscles.

Numerous wrist and forearm exercising apparatus are already known. Unfortunately, these known apparatus often develop the "wrong muscles" in the hands, wrists, forearms, and fingers for a good golf swing. For example, most wrist and forearm exercising devices strengthen the anterior muscles of the forearm, such as brachioradialis and certain other flexomuscles, rather the posterior forearm muscles. These "wrong muscles" are developed by strenuously moving the hand-held weights toward oneself. As discussed above, it is the other muscles of the shoulder, wrist, the hand, and the posterior of the forearm that are needed for a good golf swing.

In U.S. Pat. No. 3,019,019 issued to Forte, an exercising device for practicing hand wrestling is taught including an table-mount bracket with an U-shaped yoke secured to the base of the bracket and an inclined strip at right angles to the yoke. A pulley sheave is slidably mounted on the strip and a chain, carrying weights at the lower end, passes over the pulley sheaves. The top end of the chain has a handle to be grasped by the user's hand for pulling and raising the weights.

U.S. Pat. No. 4,239,208 issued to Walls teaches a wrist and forearm conditioner and exerciser. The device has a handle similar to that of a tennis racquet attached to a handle carrier, a frame rotatably mounting the carrier onto a wall, a resilient member attached on the frame and increasing the tension when the handle is rotated.

In U.S. Pat. No. 4,258,913 issued to Brentham, a forearm exercising device is disclosed. The device utilizes a fluid flow resistance means adapted to resist movement equally in either direction. The device has a support frame and a grip secured to one end of a shaft rotatably secured in the support frame and a crank arm secured on the opposite end of the shaft. A cylinder secured to the shaft controls the rate of movement of the shaft and the grip to which the user applies his arm. An upper arm support is adjustably secured to align the medial axis of the forearm with the axis of rotation of the shaft which the user is gripping to control the movement when the user moves his hand through supination and pronation. A forearm support platform is secured such that the hand and wrist extend beyond the edge of the platform when gripping the crank arm to restrain forearm movement as the hand moves the crank arm at a controlled speed.

U.S. Pat. No. 4,373,717 issued to Lambert discloses a wrist curl machine. The machine is defined by three hand grip areas, two sprockets associated with these three hand grip areas and chain elements operative connected with these sprockets which in turn traverse through weights and a counter balance system which negates the weight of the elements associated with the structure and the variable weights themselves provide the total resistance to the work done by the wrist of the forearm of the user.

U.S. Pat. No. 4,392,649 issued to Chapman teaches a hand, wrist and forearm exercising device. The device has a roller assembly adapted to be grasped by either one or both hands of the user for rolling or twisting of the assembly about its own longitudinal axis. The resistance to the rolling or twisting can be preselected by the user. The opposite ends of the roller assembly are secured to a suitable support structure, such as a bence press apparatus.

U.S. Pat. No. 4,482,149 issued to Weldon discloses an arm exercising device. It has an exercising arm adjustable to different lengths to accommodate forearms of different lengths and attached to a bearing supported lateral rod which has an upright position at the other end. The devices are attached at one end to the lateral rod, and at the opposite end, to a tension bar which is adjustable with respect to the base.

In U.S. Pat. No. 4,072,308 issued to Applegate, a portable forearm exercise is taught. The exerciser has a U-shaped frame which can be removably secured to the upper edge of a door, a bracket adjustable vertically with respect to a depending leg of the frame, a hand-manipulated weight-elevating bar rotatably mounted in the bracket, a bag selectively fillable with varying amounts of water, and a cable guiding over the upper end of the frame proximate the top of the door which connects at its opposite ends to the weighted bag and the rotatable bar to facilitate raising and lowering the bag as the bar is rotated in opposite directions by the user to reel and un-reel the cable.

U.S. Pat. No. 4,489,935 issued to Lusk discloses a weight lifting apparatus for arm development and conditioning. It is particularly suited for developing the arm for arm wrestling and for making power lifts. The apparatus has a cuff-like shackle component to fit over the forearm, with an attached hand grip member, a holding pedestal for weights, a plurality of weights to fit on the holding pedestal, and a flexible connecting member to connect the cuff-like shackle component to the holding pedestal. The cuff-like shackle component has a positioning member built into the structure to which the flexible connecting member is affixed. The positioning member is arranged so that the flexible connecting member may be conveniently and quickly reset in three different positions for three changes in exercises which the user is utilizing the cuff-like shackle component.

U.S. Pat. No. 4,570,925 issued to Kock and Schuster teaches a device for exercising muscles associated with elbow tendonitis, including also the hand and wrist. A handle mechanism, mounted on a frame, includes a fixed handle and movable handle whose movement is being resisted by a variable force. The user grasp the two handles simultaneously and exert the fingers so as to move the movable handle towards the fixed handle in opposition to the applied force. Rotation of the handle mechanism is provided with torsional resistance which may be varied.

U.S. Pat. No. 4,645,203 issued to Moss discloses a forearm developer having a cylindrical handle with a rope suspended from its center for attachment to a weight to raise the weight by twistingly rotating the handle. The handle is supported by a suspended frame having two depending parallel spaced support loops into which the opposing ends of the handle are placed for rotatable support.

It is, thus, desirable to provide an exercising device that will strengthen the precise muscles needed for activities such as golf, tennis, and baseball. What is needed for a golfer, for example, is strong shoulder, forearm, wrist and hand in a natural resistance to the speed of a swinging golf club head.

SUMMARY OF THE INVENTION

A particular goal of this invention is to provide an upper torso and limb conditioner and exerciser useful for conditioning and strengthening the shoulder, forearm, wrist, and hand thereby forming a natural resistance to the speed of a swinging golf club head. Another goal of this invention is to provide an exerciser useful for the maintenance and conditioning of upper torso and upper limb of a user. Briefly, the invention includes an apparatus for use with at least one weight in the exercising of a user's upper torso and limb. The apparatus includes a support frame with at least one upright member attached to at least one transverse top member, and at least one rest secured substantially parallel to the upright member adapted for receiving, supporting and engaging a selected region of the body of the user to facilitate the lateral or vertical movement of the upper torso and limb with respect to the body while raising and lowering the weight. A pulley sheave is movably mounted on the top member, and a flexible cord passes over the pulley sheave and is coupled to the weight at the lower end thereof. The upper end of the cord is adapted to be grasped by the user's fingers along the palm of hand for raising and lowering the weight in the exercising of the user's upper torso and limb.

An advantage of the present invention is that the weight for strengthening the desirable muscles in the upper torso and limb, such as shoulder, forearm, wrist, and hand, can be easily varied to adapt to any particular use.

Another advantage of the present invention is that the exercise can be used for exercising either the left or right upper torso and limb, such as left shoulder, forearm, wrist, and hand.

Still another advantage of the present invention is that the device can be easily mass produced.

Yet another advantage of the present invention is that the device is relative simple in construction and economical to manufacture.

Yet still another advantage of the present invention is that the exerciser is safe to use.

A still further advantage of the present invention is that, in use, the device does not occupy a large area, and can be folded for storage.

These and other objects and advantages of the present invention will become apparent upon a reading of the following descriptions and a study of the several figures of the drawing.

BRIEF DESCRIPTION OF THE DRAWINGS

For a more complete understanding of the present invention and for further objects and advantages thereof, reference may now be had to the following description taken in conjunction with the accompanying drawings in which.

DESCRIPTION OF THE PREFERRED EMBODIMENT

Figure 1B:
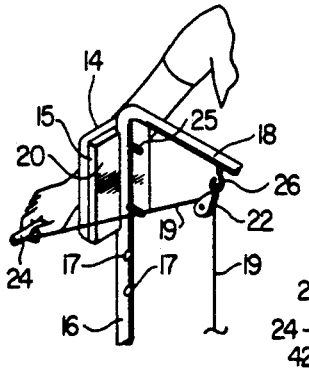
FIG. 1B is an enlarged, fragmentary perspective view of the exercising device of FIG. 1.
Figure 1A:
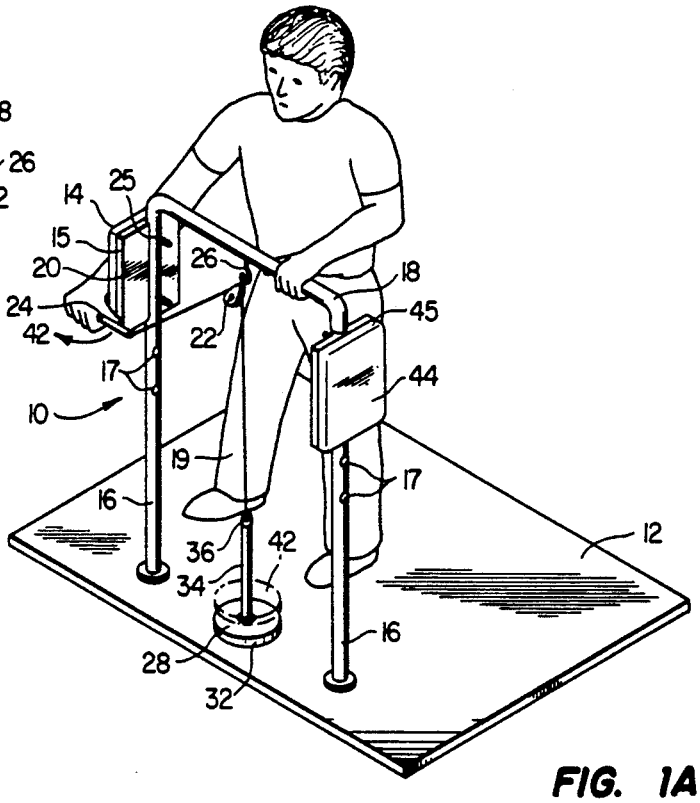
FIG. 1A is an perspective view of an upper torso and limb exercising device of the present invention showing a user using the device.

Referring generally to FIG. 1A and 1B, an upper torso and limb exercising apparatus or device 10 includes a support frame having two side members 16 extending upwardly. Secured to each of the side members 16 is a rest or support 14 adapted for engaging, receiving and supporting a selected portion of the body, such as the exterior or the anterior of the forearm of the user, thus facilitating the lateral or vertical movement of the shoulder or wrist of the user while raising and lowering the weight carried by the flange 28. By leaning or engaging either the posterior or the anterior of the forearm against surface 14, facing the side or lateral, and away from the median sagittal plane, of the device 10 of this rest or support 15, the user can thus perform the exercise needed to strengthen the muscles in the forearm, wrist, hand, and fingers required in such activities as golf, tennis and baseball.

The term upper torso as used herein denotes, in a broad sense, the shoulder and the back of a user. Among others, upper torso includes the following muscles: trapezius; latissimus dorsi; levator scapulae; deltois; rhomboid major; rhomboid minor; supraspinatus; infraspinatus; teres minor; teres major; subscapularis; quadrilateral space; triangular space; and others. Upper limb includes upper arm, forearm, wrist, hand, and fingers. The terms anterior and posterior are used to indicate the front or back of the body, respectively. Therefore, when describing the relationship of two structures or positions, one is said to be anterior or posterior to the other, as it is closer to the anterior or posterior body surface. Thus, the anterior of the forearm faces the same direction as does the palmar surface, while the posterior of the forearm faces the same direction as does the dorsal surface. Opposite to surface 14 is surface 20, which faces the median sagittal plane. A pulley sheave 22 is movably secured to a hook 26 mounted to the top horizontal member 18 of the support frame. FIG. 1A shows hook 26 is mounted near the median sagittal plane of the device 10. The median sagittal plane is an imaginary vertical plane passing through the center of the device 10, dividing the device into the right and left halves. This imaginary median sagittal plane is perpendicular to the coronal plane defined by two upwardly extending side members 16 and the top horizontal member 18. A flexible cord 19 passes over the pulley sheave 22. The lower end of cord 19 is secured to a connecting loop or eye 36 which in turn is attached to a weight supporting rod or pedestal 34. At the lower end of this weight supporting rod 34 is the flange 28 with round rim 32. Different loads of weight pieces 42, shown by the dotted phantom lines in the diagram, can be stacked onto this flange 28 to increase the force needed to raise or to lower the loading weights. Thus, the weights can be easily varied according to the desire of the person exercising. The upper end of the cord 19 is a grip piece or handle 24 adapted to be grasped by the user's fingers along the palm of hand for raising and lowering the weights in the exercising of the forearm, wrist, hand, and fingers.

Still referring to FIG. 1A, it is shown that the lower ends of the two side members 16 of the support frame are secured to a bottom platform or base 12. The figure shows the height of the rest 14 is near the chest level of the user. Surface 14 of the rest 15 is vertically oriented and parallel to the upright frame 16. Preferably, the rest 14 can be lowered or raised to a level that is comfortable for the user to engage or lean his or her forearm while exercising. One way to have this rest 14 movably mounted on the upwardly extending side member 16 is to provide the side member 16 with a plurality of receptacle holes 17, thus the securing members 25 of rest 15 can be mounted at different heights through these holes 17. Arrow 42 shows the direction of the movement of the hand. Thus, FIG. 1A shows the user has his anterior of the forearm leaning against surface 14 of the rest 15 with his fingers along the palm of hand grasping the grip piece or handle 24 at a rest position.

FIG. 1A shows the utilization of a vertical rest or pad 15 for momentarily bracing or engaging a selected portion of the body, such as the forearm, to create an equal and opposite reaction to the exercising motion. The vertical rest or pad 15 is used to balance, resist, secure, counter or engage a selected portion of the body of the user. The diagram depicts that the user is in an upright position, whereby the movement of the upper torso or limb can be imported without utilizing the other muscular skeletal system. The diagram shows the exercise that is useful for a left-handed golfer and a right-handed tennis player.

FIG. 1B shows the same exercise that the user is carrying out as in FIG. 1A except that the hand is at a stretched-out or extended position. By laterally moving the wrist and hand as shown by arrow 42, flange 28 with whatever weights it carries thereon will be raised. Moving the wrist and hand in an opposite direction as shown by arrow 42 will lower flange 28 with whatever weights it carries thereon.

Although not shown in the figures, muscles in the left forearm, left wrist and left hand can similarly by strengthened. The exercising of the left hand, left forearm and left wrist can be carried out by leaning either the exterior or the anterior of the left forearm against surface 44 of rest 45 as shown in FIG. 1A. Surface 44 faces the side or lateral, and away from the median sagittal plane, of the device 10. Alternatively, the user can simply turn around by 180°, face the other direction, and lean his forearm, either the exterior or the anterior, against surface 14 of the rest 15 as shown in FIG. 1A. This way, he can use the same rest 15 to exercise his left upper limb thereby strengthening the needed muscles for activities such as golf, tennis and baseball. Thus, the second rest 45 is optional for the present invention. In operation, movement in exercising the left upper torso and limb is the mirror image of the movement in exercising their right counter-parts.

Figure 2:
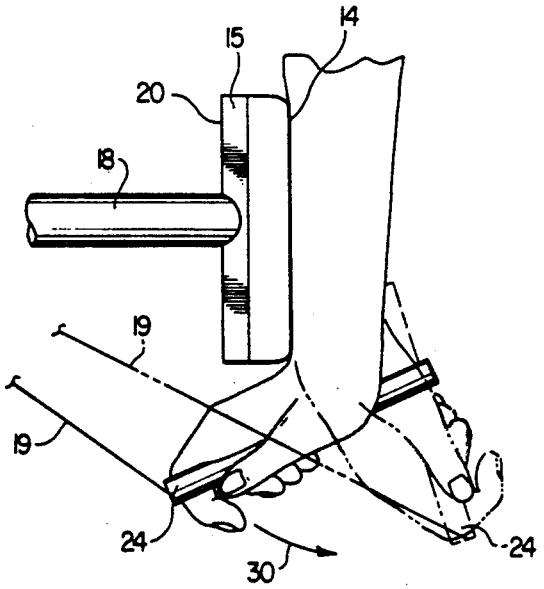
FIG. 2 is a top view highlighting the lateral movement in exercising the right upper limb.

Referring now to FIG. 2, a top view showing the posterior of the user's right forearm is leaning against, or engaging, surface 14 of the rest 15. Surface 14 faces the side or lateral, and away from the median sagittal plane, of the device 10. The figure shows fingers along the palm of hand of the user grasping the grip piece or handle 24 which is connected to cord 19. The right hand wrist moves in the direction as shown by arrow 30 to raise or lower whatever weight pieces carried by flange 28 (not shown in the diagram). The position of the hand shown in solid line is the rest position with the weight pieces lowered. The position of the hand shown in dotted line is the stretched-out position with the weight pieces raised. Also shown in the diagram is a portion of the upwardly extending side member 16 to which rest 15 is secured. The diagram illustrates the exercise that is beneficial for a right-handed golfer as well as a right-handed tennis player.

Figure 3:
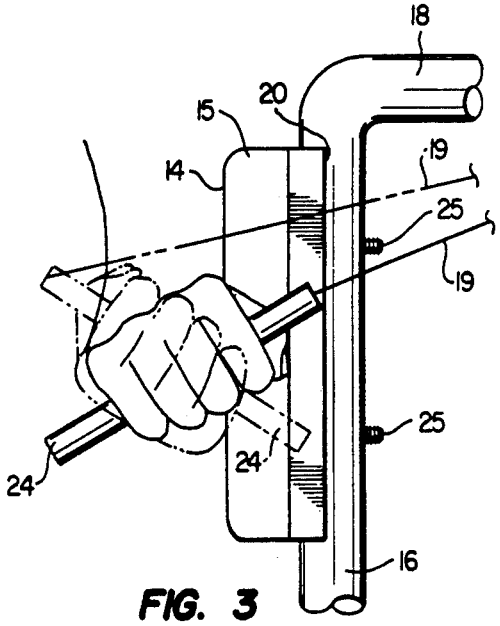
FIG. 3 is a front view highlighting the vertical movement in exercising the right upper limb.

Referring now to FIG. 3, there is shown a front view highlighting the vertical movement in exercising the right upper limb with the anterior of the right forearm engaging surface 14 of the rest 15. Surface 14 faces the side or lateral, and away from the median sagittal plane, of the device 10. The first in solid line shows the resting position with the weights (not shown in the diagram) lowered. The first shown in dotted lines illustrates the stretched-out or extended position with the weights (not shown in the diagram) raised. In operation, the wrist and forearm are rotated so that the exterior or the dorsal surface of the clinched first, grasping the grip piece 24, faces forward and upward as shown by dotted lines. The diagram illustrates the exercise that is beneficial for a right-handed golfer and a right-handed tennis player.

Figure 4:
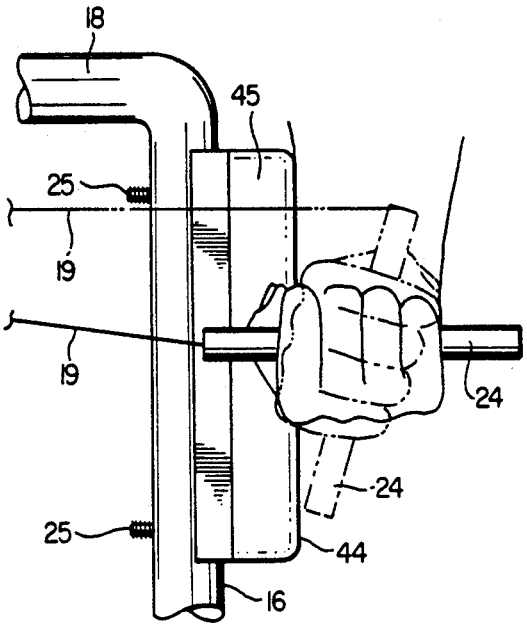
FIG. 4 is a front view highlighting another vertical movement in exercising the right upper limb.

FIG. 4 shows a frontal view highlighting the vertical movement in exercising the right upper limb. The posterior of the user's right forearm engages surface 44 of the rest 45 which is attached to the upright frame member 16 by security members 25. The first in solid lines shows the resting position with the weights (not shown in the diagram) lowered. The fist shown in phantom lines illustrates the stretched-out or extended position with the weights (not shown in the diagram) raised. This diagram illustrates the exercise that is beneficial for a right-handed golfer.

Figure 5:
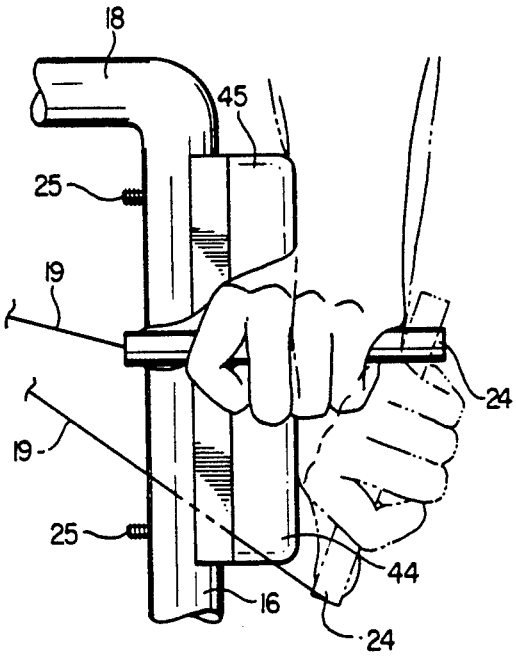
FIG. 5 is a front view highlighting the vertical movement in exercising the left upper limb.

FIG. 5 shows a frontal view highlighting another vertical movement in exercising the left upper limb. Here the fist shown in dotted lines illustrates the stretched-out or extended position with the weights (not shown in the diagram) raised. The fist in solid line shows the resting position with the weights (not shown in the diagram) lowered. The exercise is particularly suitable for a right-handed golfer.

Figure 6:
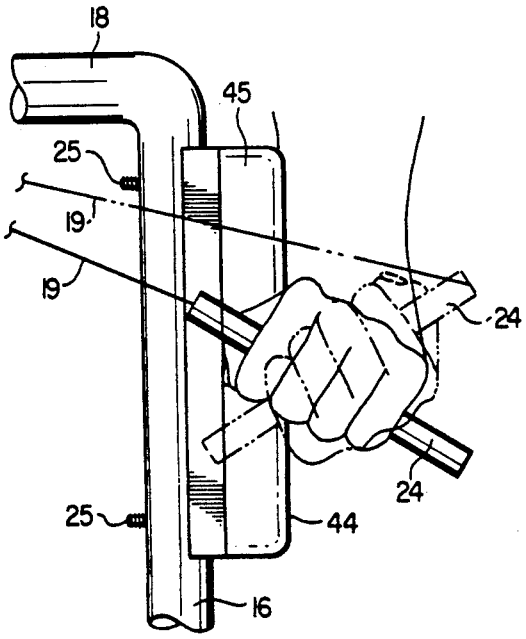
FIG. 6 is a front view highlighting another vertical movement in exercising the left upper limb.

FIG. 6 illustrates a frontal view highlighting yet another vertical movement in the exercise of the left upper limb. The fist shown in dotted lines illustrates the stretched-out or extended position with the weights (not shown in the diagram) raised. The fist in solid line illustrates the resting position with the weights (not shown in the diagram) lowered. Again, the exercise is beneficial for a right-handed golfer.

Figure 7:
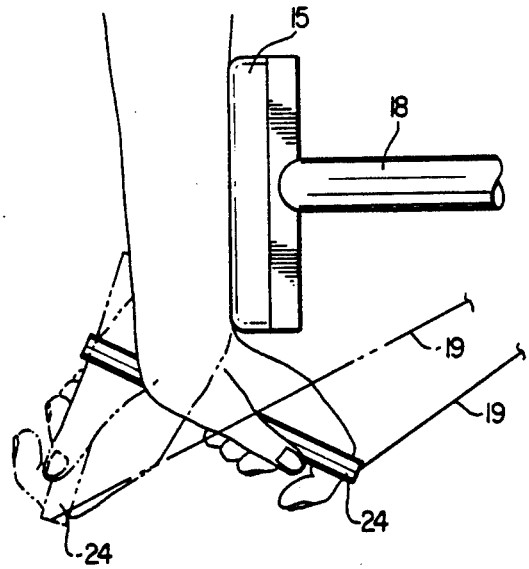
FIG. 7 is a top view highlighting the lateral movement in exercising the left upper limb.

FIG. 7 is a top view highlighting the lateral movement in exercising the left upper limb. The figure in solid lines shows the resting position with the weights (not shown in the diagram) lowered. The figure in dotted lines illustrates the stretched-out or extended position with the weights (not shown in the diagram) raised. The exercise depicted in this figure is beneficial to a left-handed golfer or a left-handed tennis player.

Figure 8:
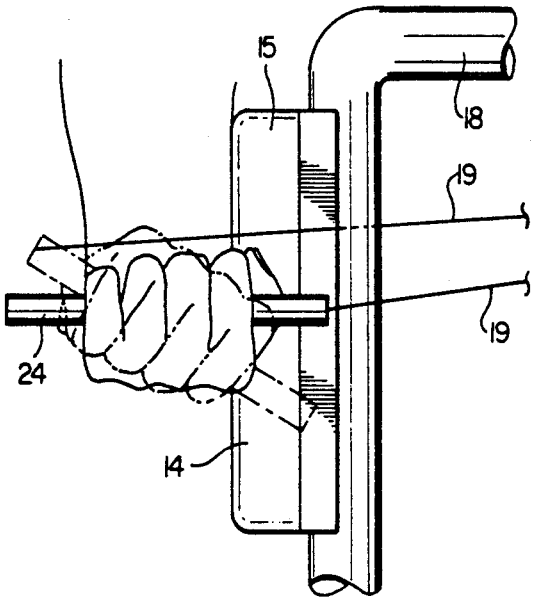
FIG. 8 is a front view highlighting yet another vertical movement in exercising the left upper limb.

FIG. 8 is a frontal view highlighting still another vertical movement in exercising the left upper limb. The figure depicted in solid lines shows the resting position with the weight (not shown in the diagram) lowered. The figure depicted in dotted lines illustrates the stretched-out or extended position with the weights (not shown in the diagram) raised. The exercise shown in this figure is beneficial to a left-handed golfer as well as a left-handed tennis player.

Figure 9A:
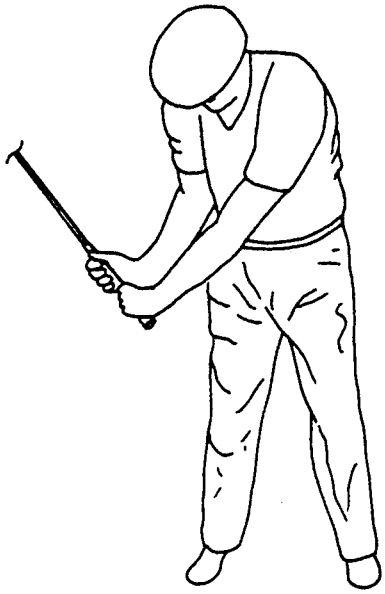
FIG. 9A shows a right-handed golfer at the beginning of swinging a golf club.

FIG. 9A shows a right-handed golfer near the beginning of swinging a golf club. Here, both his right and left wrists are fully cocked.

Figure 9B:
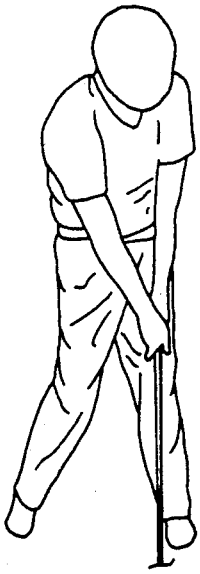
FIG. 9B shows a right-handed golfer swinging a golf club reaching a middle position.

FIG. 9B shows a right-handed golfer swinging a golf club nearing the "middle" position, when the club impacts the golf ball. Here both his left and right wrists are completely uncocked.

Figure 10:
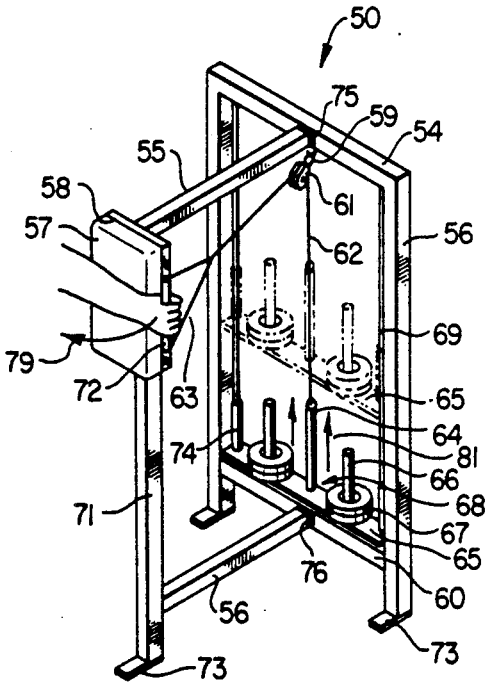
FIG. 10 shows another embodiment of the present invention.

Referring now to FIG. 10. It shows another embodiment 50 of the present invention. The upper ends of two upright members 56 join a horizontal top member 54. Near the bottom, the two upright members 56 are again secured to another horizontal lower member 60. The pair of upright members 56 and the two horizontal members, 54 and 60, form an imaginary plane, a coronal plane, with two surfaces, a front and a rear surface. A third upright member 71 is disposed in a parallelly spaced relationship to the front surface of the imaginary coronal plane. This third upright member 71 is foldably attached (via hinges 75 and 76) to two horizontal members 54 and 60 by means of a first and a second transverse member, 55 and 56, respectively. The third upright member 71 and the two transverse members 55 and 56 form another imaginary plane, the median sagittal plane. A vertical rest 58 is secured in a parallel relationship to the third upright member 71. All three upright members are supplied with support platforms 73 at the bottom. A pulley sheave 61 is movably secured to a hook 59 mounted on the horizontal top member 54. Hook 59 is mounted near the median sagittal plane of the device 50. A first flexible cord 62 passes over the pulley sheave 61. The lower end of the cord 62 is secured through a rod to a weight-holding device 68. Weight-holding device 68 has a transverse support member 65 with two rods 66 for holding removable weights 67. While resting, weight-holding device 68 sits on the horizontal member 60. Near both ends of the support member 65 are two cylindrical tubes guiding the up-and-down movement of the weight-holding device 68, by sliding along the guide rods 69. The upper end of the cord 62 is secured to one end of the handle 72. The opposite end of the handle is attached through a separate cord 63 to the first cord 62. The right forearm engages surface 57 of the rest 58. When the handle is moved in the direction as shown by arrow 79, the weight holding device 68 moves in the direction as depicted by arrow 81. The exercise as shown here is beneficial to a right-handed golfer and a right-handed tennis player.

Figure 11:
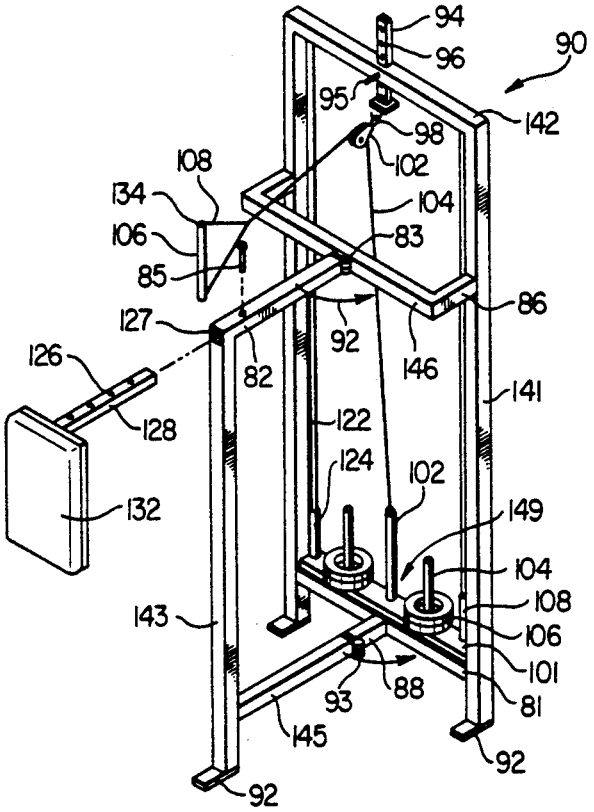
FIG. 11 shows yet another embodiment of the present invention.

Referring now to FIG. 11 in which it is shown still another embodiment of the present invention. The upper ends of the first two upright members 141 join a horizontal top member 142. Near the bottom, the two upright members 141 are again secured to another lower horizontal member 81. The pair of upright members 141 and the two horizontal members, 142 and 81, form an imaginary plane, a coronal plane, having two surfaces, a front and a rear surface. A transverse member 88 is secured to the lower horizontal member 81 in an imaginary median sagittal plane. Attached near the upper ends of the first two upright members 141 are two ends of two horizontal cross frame members 86. The opposite ends of the two horizontal cross frame members 86 are secured to an upper latitudinal member 146. A third upright member 143, shorter in height than the first two upright members 141, is disposed in a parallelly spaced relationship to the frontal surface of the imaginary coronal plane. This third upright member 143 is equipped near the lower end with a lower transverse member 145, which is foldably secured, via a hinge 93, to another lower transverse member 88. The upper end of the third upright member 143 is attached to an upper transverse member 82 which is foldably secured, via a hinge 83, to the upper latitudinal member 146. A vertical rest 132 is slidably secured in a parallel configuration to the third upright member 143. A horizontal bar 128 with adapting holes 126 slides into the upper transverse frame member 82 through a tunnel 127. The horizontal bar 128 is then secured in place by a screw 85 which fits into one of the holes 126. All three upright members in this embodiment are equipped with support platforms 92 at the bottom.

Still referring to FIG. 11, a pulley sheave 102 is movably secured to a hook 98 which is mounted to a vertical support member 94 which is slidably attached to the top horizontal frame 142. Holes 96 provide means to receive screw 95 for positioning the vertical support member 94 at a desired position. The vertical support member is placed near the median sagittal plane of the device 90. A first flexible cord 104 passes over the pulley sheave 102. The lower end of the cord 104 is secured through a rod to a weight-holding device 149. Weight-holding device 149 has a transverse support member 101 with two rods 104 for holding removable weights 106. While resting, weight-holding device 149 sits on a horizontal member 81. Near both ends of the transverse support member 101 are two cylindrical tubes guiding the up-and-down movement of the weight-holding device 149 by sliding along the guide rods 122. The upper end of the cord 104 is secured to one end of a handle 106. The opposite end 134 of the handle 106 is attached through a separate cord 108 to the first cord 104.

Figure 12:
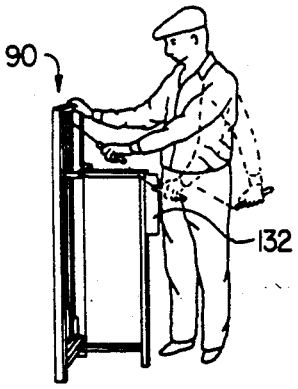
FIG. 12 shows exercising the left upper torso.

Referring now to FIG. 12, it is shown a user exercising his left upper torso using the device as shown in FIG. 11. Here, the user engages his hip against a vertical rest 132 and pulls the weights in a direction as shown by the dotted lines. The rest 132 supports and braces the skeletal system of the user, thus, movement of other part of the body is resisted. The exercise is beneficial to a right-handed golfer.

Figure 13:
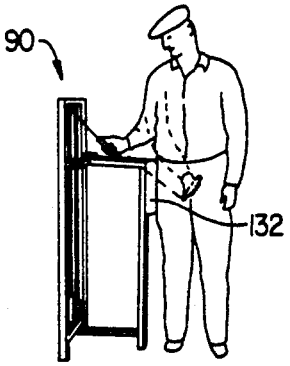
FIG. 13 shows exercising the right upper torso.

Referring to FIG. 13, it is shown a user exercising his right upper torso using the device shown in FIG. 11. Again, as in FIG. 12, the vertical rest 132 engages the side of hip of the user. The exercise is useful beneficial to a right-handed golfer and a right-handed tennis player.

Figure 14:
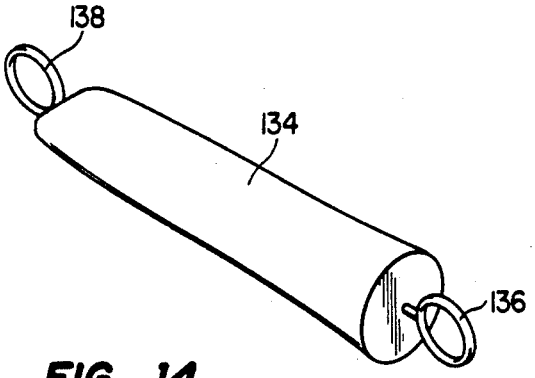
FIG. 14 shows a handle resembling the grip of a tennis racket.

FIG. 14 shows a handle 134 with one ring at end for connection to a flexible cord. The handle is in the shape of a grip of a tennis racket. This is one type of handle that is used in FIGS. 10 and 11.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. Apparatus for exercising comprising:
- a support frame having an upright member attached to a transverse top member;
- a variable weight disposed relative to said support frame;
- a substantially vertical rest member having two substantially planar surfaces, one of which surfaces being directly secured in a substantially parallel configuration to said upright member for engaging a selected region of a user's body;
- a pulley sheave movably and swivellingly mounted on said top member; and
- a flexible cord passing over said movably and swivellingly mounted pulley sheave and coupled to said weight at the lower end thereof, the upper end of said cord being adapted to be grasped by the user's fingers along the palm of said user's hand for drawing said cord across said pulley to raise and lower said weight and exercise said user's upper torso and limb.

2. The apparatus of claim 1 wherein said support frame is secured to a platform.

3. The apparatus of claim 1 wherein said rest is movably secured to said upright member.

4. The apparatus of claim 1 wherein said variable weight comprises a plurality of removable plates.

5. Apparatus for exercising comprising:
- a support frame comprising at least a pair of upright frame members connected by a transversely extending top frame member;
- a variable weight disposed relative to said support frame;
- at least one substantially vertical rest member having two substantially planar surfaces, one of which surfaces being directly secured in a substantially parallel configuration to said upright member for engaging a selected region of a user's body;
- a pulley sheave movably and swivellingly mounted to said top frame member; and
- a flexible cord passing over said movably and swivellingly mounted pulley sheave and coupled to said variable weight at the lower end thereof, the upper end of said cord being adapted to be grasped by the user's fingers along the palm of said user's hand for drawing said cord across said pulley to raise and lower said weight and exercise said user's upper torso and limb.

6. The apparatus of claim 5 wherein said upright frame members and said top frame member form an inverted U-shaped frame.

7. The apparatus of claim 5 wherein said at least one rest is movably secured to said upright frame member.

8. The apparatus of claim 5 wherein said variable weight comprises a plurality of removable plates secured to said cord.

9. Apparatus for exercising comprising: a support frame comprising:
- a bottom platform;
- at least a pair of upright frame members secured to said bottom platform; and
- at least one transversely extending top frame member connecting said upright frame members;
- two substantially vertical rest members each having two substantially planar surfaces, one of which surfaces being directly secured in a substantially parallel configuration to each of the two said upright frame members for engaging a selected region of a user's body;
- a variable weight disposed relative to said support frame;
- hanging means attached to said top frame member;
- a pulley sheave movably and swivellingly mounted to said hanging means; and
- a flexible cord passing over said movably mounted pulley sheave, the lower end of said cord being coupled to said variable weight and the upper end of said cord being provided with a grip adapted to be grasped by the user's fingers along the palm of said user's hand for drawing said cord across said pulley to raise and lower said weight and exercise the user's upper torso and limb.

10. The apparatus of claim 9 wherein said upright frame members and said top frame member form an inverted U-shaped frame.

11. The apparatus of claim 9 wherein said rest is movably secured to said upright frame member.

12. The apparatus of claim 9 wherein said variable weight comprises a plurality of removable plates secured to said cord.

13. Apparatus for use with at least one weight in exercising a user's upper torso and limb, said apparatus comprising:
- a support frame comprising a first and a second upright frame members each said frame member having an upper end;
- a substantially horizontal top frame member attached to said upper end of each said upright frame member defining an imaginary plane having a front surface and a rear surface;
- a third upright frame member in a substantially parallel spaced relationship to said front surface of said imaginary plane, said third upright frame member being shorter in height than said first two upright frame members;
- at least one transverse frame member having one end securely attached to said third upright frame member, and having the opposite end securely attached to at least one said first two upright frame members;

at least one substantially vertical rest member having two substantially planar surfaces, one of which surfaces being slidably secured in a substantially parallel configuration to said third upright frame member for engaging a selected region of the user's body to facilitate the lateral or vertical movement of said upper torso and limb with respect to said body while raising and lowering said weight;

a vertical suspension means adjustably mounted to said top frame;

a pulley sheave movably and swivellingly mounted on said suspension means; and a flexible cord passing over said pulley sheave and coupled to said weight at the lower end thereof, the upper end of said cord being provided with a grip adapted to be grasped by the user's fingers along the palm of hand for drawing said cord across said pulley to raise and lower said weight and exercise said user's upper torso and limb.

14. The apparatus of claim 13 wherein said transverse frame member is foldably secured to one of said first two upright frame members.

15. The apparatus of claim 13 wherein said first two upright frame members and said top frame member form an inverted U-shaped frame.

16. The apparatus of claim 13 wherein said weight comprises a weight supporting rod secured to a round rim for carrying a plurality of removable plates.

17. Apparatus for use with at least one weight in exercising a user's upper torso and limb, said apparatus comprising:

a support frame comprising a first and a second upright frame members each said frame member having an upper end;

a substantially horizontal top frame member attached to said upper end of each said upright frame member defining an imaginary plane having a front surface and a rear surface;

a third upright frame member in a substantially parallel spaced relationship to said front surface of said imaginary plane, said third upright frame member being shorter in height than said first two upright frame members;

at least one transverse frame member having one end securely attached to said third upright frame member and having the opposite end securely attached to at least one said first two upright frame members;

an upper latitudinal member extending substantially horizontally and being substantially parallel to said from surface of said imaginary plane;

two lateral cross frame members each having one end secured to one of said first upright frame members and each having the opposite end secured to said upper latitudinal member;

at least one substantially vertical rest member having two substantially planar surfaces, one of which surfaces being slidably secured in a substantially parallel configuration to said third upright frame member for engaging a selected region of the user's body to facilitate the lateral or vertical movement of said user's upper torso and limb with respect to said body while raising and lowering said weight;

a vertical suspension means adjustably mounted to said top frame;

a pulley sheave movably and swivellingly mounted on said suspension means; and a flexible cord passing over said pulley sheave and coupled to said weight at the lower end thereof, the upper end of said cord being provided with a grip adapted to be grasped by the user's fingers along the palm of hand for drawing said cord across said pulley to raise and lower said weight and exercise said user's upper torso and limb.

18. The apparatus of claim 17 wherein said transverse frame member is foldably secured to said upper latitudinal member.

19. The apparatus of claim 17 wherein said weight comprises a weight supporting rod secured to a round rim for carrying a plurality of removable plates.

* * * * *